United States Patent [19]

Rodi

[11] Patent Number: 4,991,506

[45] Date of Patent: Feb. 12, 1991

[54] DEVICE FOR DRYING PRINTED PRODUCTS IN A PRINTING MACHINE

[75] Inventor: Anton Rodi, Leimen, Fed. Rep. of Germany

[73] Assignee: Heidelberger Druckmaschinen AG, Heidelberg, Fed. Rep. of Germany

[21] Appl. No.: 398,631

[22] Filed: Aug. 25, 1989

[30] Foreign Application Priority Data

Aug. 25, 1988 [DE] Fed. Rep. of Germany ..... 3828753

[51] Int. Cl.[5] ..... B41F 23/04

[52] U.S. Cl. ..... 101/416.1; 118/DIG. 1

[58] Field of Search ..... 101/416.1; 34/4, 41; 118/DIG. 1

[56] References Cited

U.S. PATENT DOCUMENTS

| | | | |
|---|---|---|---|
| 3,960,081 | 6/1976 | Gustavs et al. | 101/416.1 |
| 4,189,630 | 2/1980 | Ebert | 34/4 |
| **4,297,000** | **10/1981** | **Fries.** | |
| 4,799,361 | 1/1989 | Linner | 34/5 |
| 4,816,691 | 3/1989 | Faatz | 250/484.1 |

FOREIGN PATENT DOCUMENTS

| | | |
|---|---|---|
| 2145988 | 3/1973 | Fed. Rep. of Germany . |
| 133058 | 7/1984 | Japan . |
| 2031298 | 4/1980 | United Kingdom . |

OTHER PUBLICATIONS

Publication: LAMBDA Lasertechnik "LPX The 5th Generation in Excimer Lasers", pp. 2-20.

*Primary Examiner*—Edgar S. Burr
*Assistant Examiner*—Ren Yan
*Attorney, Agent, or Firm*—Herbert L. Lerner; Laurence A. Greenberg

[57] ABSTRACT

A device for drying printed products in a printing machine having a transport device for conveying printed products along a given path includes a radiation device located outside the printing machine for generating radiant energy, and a device for transmitting the radiant energy generated by the radiation device to a surface of the printed product, the transmitting device being disposed at least partly in the printing machine so as to direct the radiant energy simultaneously over a defined width of the surface of the printed product.

3 Claims, 2 Drawing Sheets

DEVICE FOR DRYING PRINTED PRODUCTS IN A PRINTING MACHINE

Figure 1:
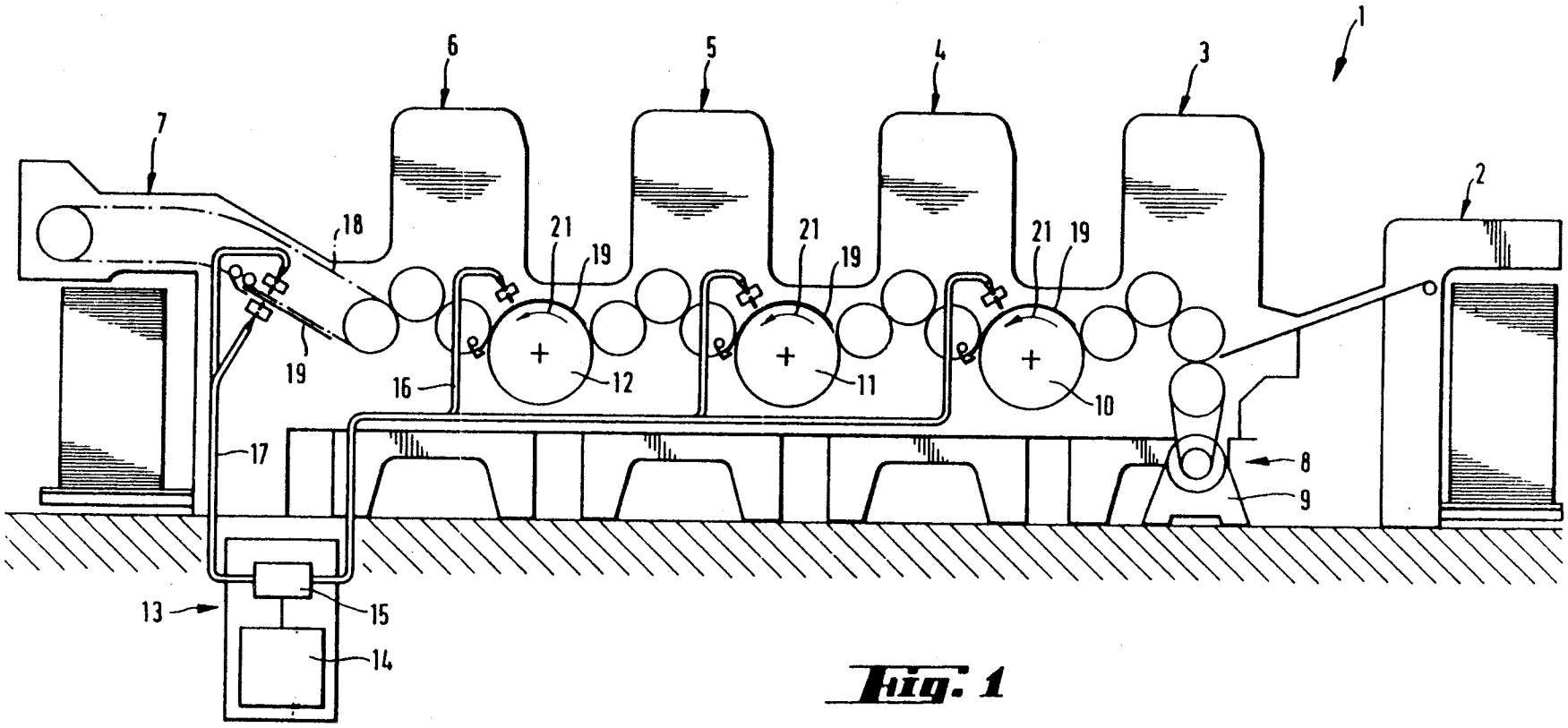

The invention relates to a device for drying printed products in a printing machine and, more particularly, a printing machine having a transport device for conveying printed products.

A device in which a laser light source generates a laser beam has become known heretofore from published Japanese Patent Application 59-133058. This laser beam is guided by a rotating polygonal mirror onto a printed product which is moved continuously underneath the laser beam. By means of this rotating polygonal mirror, the laser beam oscillates over the width of the printed product and effects a heating and, thereby, a drying of the printing ink which has been applied to the printed product.

This heretofore known device has a disadvantage in that the laser beam heats the printed product only at a point. This demands a very high energy density because the point of impingement of the laser beam must be guided over the printed product at high speed in order to cover the entire area thereof. Moreover, a drive unit is required for the polygonal mirror.

A further disadvantage of the foregoing heretofore known device is that the radiation device must be placed as much as possible in the proximity of the freshly printed product i.e. in the printing machine itself, in order to avoid long beam paths. Because the radiation device produces a considerable amount of heat due to energy loss, undesired local heating, even of printing machine parts, occurs. Such local heating within the printing machine is detrimental to the operability of the in-register bearings, on the one hand, and, presents the risk of register errors in the printed image caused by the thermal expansion of certain mechanical parts, on the other hand.

Heretofore, attempts have been made, in fact, to prevent this heating of printing machine parts by placing the radiation device at a given distance from the directly neighboring parts of the printing machine so that ventilation of the radiation device was possible. This requires a very large installation space, however. Especially in the case of a printing machine, such additional bulky or large volume parts are very disadvantageous and disruptive because the installation space which is available is needed for other parts, e.g. sensors or adjusting elements, and because all parts of the printing machine should be readily accessible from the outside.

It is accordingly an object of the invention to provide a drying device of the foregoing general type which succeeds in eliminating negative influences exerted on the printing machine which are caused by dissipated heat from the radiation device and achieving ink drying as rapidly as possible by optimally utilizing the radiant energy.

With the foregoing and other objects in view, there is provided, in accordance with the invention, a device for drying printed products in a printing machine having a transport device for conveying printed products along a given path, comprising a radiation device located outside the printing machine for generating radiant energy, and means for transmitting the radiant energy generated by the radiation device to a surface of the printed product, the transmitting means being disposed at least partly in the printing machine so as to direct the radiant energy simultaneously over a defined width of the surface of the printed product.

An important advantage of the construction of the invention is consequently that unnecessary heating in the printing machine is avoided by placing the radiation device, which may be a laser beam source, for example, outside the printing machine. The laser beam is transmitted by suitable transmitting means having low energy loss or dissipation. It is, furthermore, advantageous to have the radiation energy impinge simultaneously on the entire width of the surface of the printed product or on a linear part thereof. Thus, radiation energy does not impinge on the printed product point by point, but rather, a line at a time, which has a better drying effect and results in a higher drying speed.

In accordance with another feature of the invention, the transmitting means comprise a fiber-optics cable operatively connected to the radiation device for receiving therefrom the radiant energy generated thereby. By means of optical fibers, it is possible to bridge great distances between a radiation device and the location where the radiation energy is used. If the fiber-optics cable is formed of a plurality of individual fibers, its end can be fanned out linearly i.e. the individual optical fibers can be separated or split into one or more rows terminating just above the surface of the printed product. The width of such a row corresponds to the width of the surface to be dried.

In accordance with a further feature of the invention, the transmitting means comprise at least one gas-filled tube operatively connected to the radiation device for receiving therefrom the radiant energy generated thereby. It is recommended that nitrogen be used for the gas filling or content. With such a tube it is also possible to realize very long guide paths. For generating a line of radiation energy, an optical beam splitter is provided at the end of the tube.

In accordance with a further feature of the invention, the transmitting means comprise an elongated member having a substantially linear-shaped end facing in a direction towards the printed product and being locatable above the surface of the printed product.

In accordance with an added feature of the invention, the end of the elongated member facing towards the printed product has an optical beam splitter for directing the radiant energy linearly onto the surface of the printed product.

Ultraviolet (UV) inks presently employed in offset printing are cured by being exposed to ultraviolet light. When compared to solvent-containing inks, UV inks have the advantage that they are dried without unnecessarily heating the printed products. It is, therefore, expedient, in accordance with yet another feature of the invention, to provide a radiation device having means for generating radiation having a wavelength which lies within the ultraviolet range.

In accordance with yet a further feature of the invention, the gas-filled tube has an inner coating for reflecting radiant energy. The gas-filled tube may thus be provided with an inner coating which reflects ultraviolet light. Such an inner coating permits the tube to be arbitrarily placed in position just like an optical fiber or fiberoptics cable. Deflecting mirrors and straight tube conduit or guidance are not required.

In accordance with yet an additional feature of the invention, wherein the printed product has an ink application thereon of varying structure, the device further comprises sensor means for determining the structure of ink application on the printed product, and a control device for receiving signals from the sensor means corresponding to a determined structure of ink application on the printed product and varying the intensity of the radiant energy in accordance with the determined structure of ink application on the printed product.

The entire device can be integrated into a control circuit for controlling the radiation energy which is to be supplied. Because the entire area of a printed product is very seldom printed on, the printed product having blank or non-image areas very often, it is advantageous not to have any radiation or radiant energy impinge on the non-image areas of the printed product or printed sheet. This means that radiant energy is fed only to those areas of the printed sheet which need it for drying the ink. The control device which controls the radiant energy is fed via sensors with the information on the inked and non-inked areas, respectively, of the printed product. The sensors are directed onto the printed sheet in the same manner, for example, as is the impingement line of the radiation energy, and scan or determine the application of ink on this sheet. Signals generated by the sensors are fed to the control device which controls the intensity of the radiation energy by means of these signals.

Instead of such a sensor arrangement, in accordance with yet an added feature of the invention, the device is provided with electronic memory means wherein data regarding the structure of the ink application on the printed product are storable, the memory means being operatively connected to the control means for receiving stored data therefrom and for controlling the intensity of the radiant energy in accordance with the stored data. By reading out the memory contents cyclically and feeding them to the control device, the radiation intensity and the switching of the radiation or radiant energy, respectively, are controlled in a similar manner.

In accordance with a concomitant feature of the invention, the radiation device has means for generating radiant energy of varying wavelengths, and means for selecting radiant energy of a given wavelength to be generated thereby in accordance with at least one characteristic of an ink to be dried. An advantage thereof is that it is possible thereby to dry inks which become cured in different ultraviolet wavelength ranges. Respective ultraviolet-wavelength ranges are selected depending upon the inks which are used, and the radiation device is activated by the respective wavelength.

Other features which are considered as characteristic for the invention are set forth in the appended claims.

Although the invention is illustrated and described herein as embodied in a device for drying printed products in a printing machine, it is nevertheless not intended to be limited to the details shown, since various modifications and structural changes may be made therein without departing from the spirit of the invention and within the scope and range of equivalents of the claims.

Figure 2:
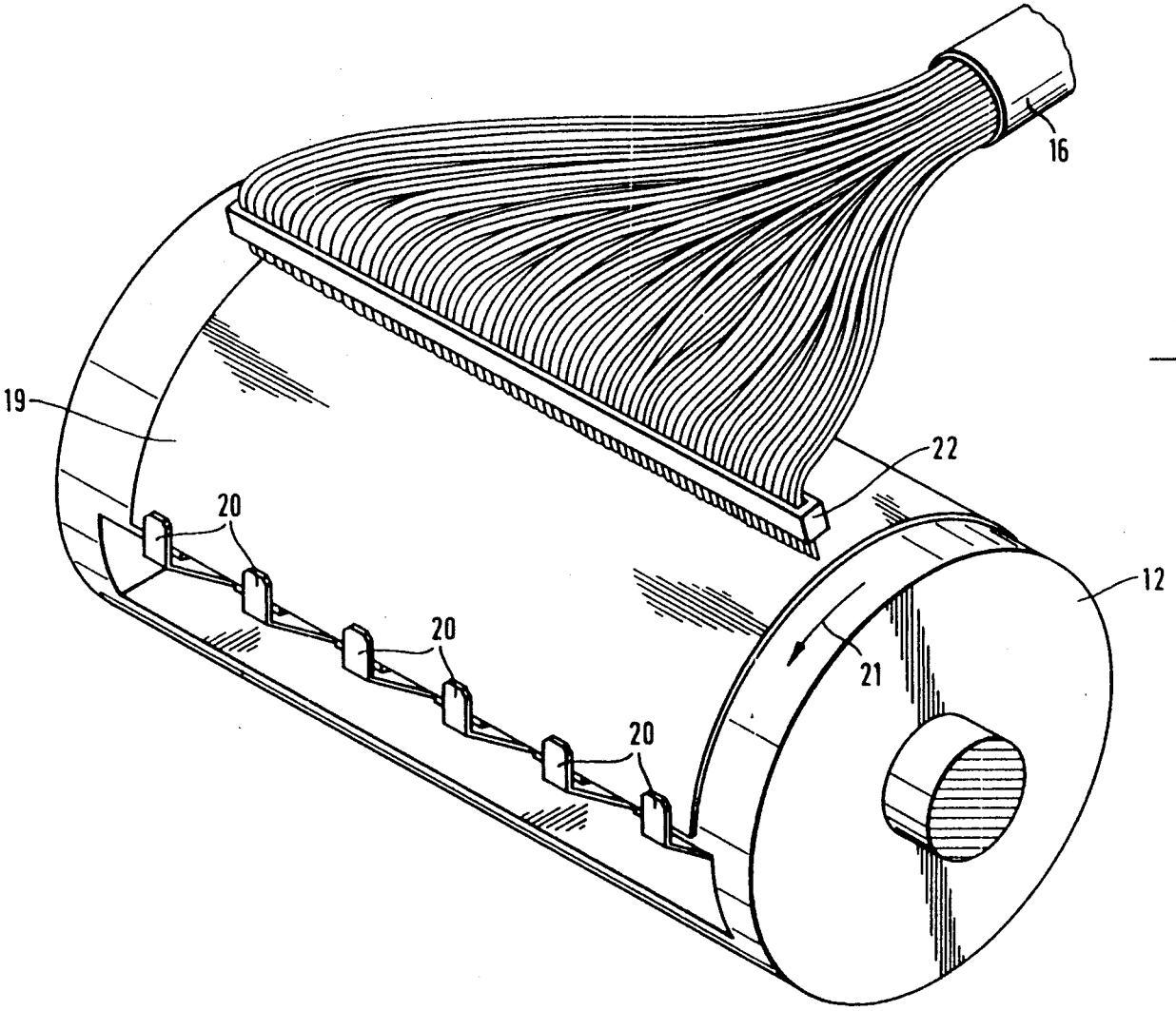

The construction and method of operation of the invention, however, together with additional objects and advantages thereof will be best understood from the following description of specific embodiments when read in connection with the accompanying drawings, in which:

FIG. 1 is a sheet-fed printing machine including a drying device according to the invention; and FIG. 2 is a fragmentary perspective view of FIG. 1 showing a fiber glass cable above a printed product which is to be dried.

Referring now to the drawing and first, particularly, to FIG. 1 thereof, there is shown diagrammatically a sheet-fed offset printing machine having a sheet feeder 2, four printing units 3, 4, 5 and 6 and a sheet delivery 7. An electric motor 9 serves as the drive 8 of the printing machine. Transfer drums 10, 11 and 12 are arranged between the individual printing units, and convey sheets from one printing unit to the next. Sheet transport is effected longitudinally along a transport path represented by the arrow 21 (FIG. 2). While a printed sheet 19 is transported by the transfer drums 10, 11 and 12, the printed side of the sheet 19 faces outwardly so that it is possible for the freshly printed surface to pass a drying device. An appropriate drying device is made up of several components of which a first component is a device for generating radiation energy such as a laser radiation device 13. Such a laser radiation device 13 includes an electronic control unit 14 and a laser tube 15. This laser radiation device 13 is known, for example, from the publication "Lambda Physik Laserstrahltechnik" by Lambda Physik GmbH, Göttingen, Federal Republic of Germany.

The laser beam which is generated by the laser tube 15 is fed into a fiber-optics cable 16, 17 formed, for example, of a bundle of optical fibers constituting other components of the drying device. The entire laser radiation device 13 is accommodated in an appropriate housing outside the printing machine 1. The fiber-optics cable 16, 17 is the only connection between the laser radiation device 13 and the printing machine 1. The ends of the fiber-optics cable 16 extend towards and close to the transfer drums 10, 11 and 12 of the individual printing units 3, 4, 5 and 6 and terminate shortly above the outer cylindrical surfaces of these transfer drums 10, 11 and 12. The ends of the fiber-optics cable 17 run to a chain delivery 18 which conveys the printed sheets to the sheet delivery 7. Thereafter, both sides of the printed sheets are dried in the region of the chain delivery. Moreover, the ink and/or varnish coating applied by the printing unit 6 are dried.

An embodiment of the end of a fiber-optics cable 16 is shown in detail in FIG. 2. The printed sheet 19 on the transfer drum 12 is held fast at its leading end by grippers 20 and conveyed longitudinally along the transport path 21. The end of the fiber-optics cable 16 is attached to a traverse or cross-bar 22 located above the transfer drum 12 and suitably secured to non-illustrated side frames of the printing machine. As is apparent from FIG. 2, the fiber-optics cable 16 is split up i.e. the individual fibers of the cable are arranged so that they form a line extending transversely to the transport direction of the sheet 19. The laser beam emerging from the ends of the fiber-optics cable 16 strikes the sheet surface almost vertically.

Given a sufficient number of individual optical fibers, it is also possible to arrange several rows of optical fibers one behind the other. A longer exposure of the sheet to radiation during its transport movement results therefrom and thus ensures reliable curing of the ink at very high transport speeds.

Instead of a single laser tube 15, as shown in FIG. 1, it is also possible to arrange several laser tubes, each of which generates a laser beam of a given wavelength. The laser beams of varying wavelengths are fed to the individual printing units via a common fiber-optics cable or separate cables. Due to this multiple laser, each printed ink is cured optimally in accordance with its absorption behavior and its curing properties.

It is also possible to apply a so-called ultraviolet excimer laser for generating a laser beam. With such ultraviolet radiation devices, excimers are formed by electric discharge under specific discharging conditions. Excimers are molecular complexes e.g. $Xe_2$, which emit ultraviolet radiation when disintegrating. In this case, an ultraviolet radiation device which operates within a specific wavelength range ensuring optimum drying can be utilized for each desired application.

I claim:

1. Device for drying printed products in a printing machine having a transport device for conveying printed products along a given path, comprising a radiation device located outside the printing machine for generating radiant energy, and means for transmitting the radiant energy generated by the radiation device to a surface of the printed product, said transmitting means being disposed at least partly in the printing machine so as to direct the radiant energy simultaneously over a defined width of said surface of the printed product, and said transmitting means comprising an elongated member having at least one optical fiber having an end thereof a substantially linear-shaped body with at least one optical fiber having an end thereof facing in a direction toward the printed product and being locatable above the surface of the printed product.

2. Device according to claim 1, wherein the transmitting means comprise a fiber-optics able operatively connected to said radiation device for receiving therefrom the radiant energy generated thereby.

3. Device according to claim 1, wherein said radiation device has means for generating a laser beam having a wavelength within the ultraviolet range.

* * * * *